US005806334A

United States Patent [19]

Shin

[11] Patent Number: 5,806,334

[45] Date of Patent: Sep. 15, 1998

[54] COOLING APPARATUS HAVING A SPIRALLY WOUND CONDUCTIVE PIPE

[75] Inventor: Jun-Chul Shin, Incheon, Rep. of Korea

[73] Assignee: Daewoo Electronics Co., Ltd., Seoul, Rep. of Korea

[21] Appl. No.: 798,820

[22] Filed: Feb. 12, 1997

[30] Foreign Application Priority Data

Jun. 4, 1996 [KR] Rep. of Korea ..... 1996 14827

[51] Int. Cl.[6] ..... F25D 17/04; F28D 1/04

[52] U.S. Cl. ..... 62/407; 62/515; 165/125; 165/151

[58] Field of Search ..... 62/407, 515, 467; 165/125, 151

[56] References Cited

U.S. PATENT DOCUMENTS

| | | | |
|---|---|---|---|
| 1,893,341 | 1/1933 | Spreen | 62/407 |
| 2,001,832 | 5/1935 | Bandurski | 165/125 |
| 2,044,832 | 6/1936 | Child | 165/125 |
| 2,495,351 | 1/1950 | Smith | 165/125 |
| 3,783,635 | 1/1974 | Perez | 62/276 |
| 4,756,358 | 7/1988 | O'Neal | 62/276 |
| 5,077,825 | 12/1991 | Monrose | 392/361 |
| 5,088,550 | 2/1992 | Tippman et al. | 165/117 |
| 5,255,535 | 10/1993 | Kennedy | 62/515 |

FOREIGN PATENT DOCUMENTS

| | | | |
|---|---|---|---|
| 865167 | 4/1961 | United Kingdom | 165/125 |

*Primary Examiner*—William Doerrler
*Attorney, Agent, or Firm*—Jacobson, Price, Holman & Stern, PLLC

[57] ABSTRACT

A cooling apparatus for use in a cooling system. The cooling apparatus comprises an evaporator having a conductive pipe which is wound spirally along a cool air duct, and a blower for providing a cooling compartment with cool air generated from the evaporator by blowing toward the evaporator. The diameter of the wound portion of the conductive pipe increases gradually along the circulating direction of the cool air, so the evaporator substantially has a cone-shape. In the cone-shaped space, a defrosting heater is disposed coaxially with the conductive pipe. Since the heat exchange is performed uniformly on the entire area of the evaporator by the spirally wound conductive pipe, the cooling apparatus has high efficiency of cooling, and since frost is generated on the evaporator without maldistribution thereby, the period for defrosting operation becomes longer so that the cooling efficiency is more improved.

3 Claims, 5 Drawing Sheets

COOLING APPARATUS HAVING A SPIRALLY WOUND CONDUCTIVE PIPE

BACKGROUND OF THE INVENTION

1. Field of the Invention

The present invention relates to a cooling apparatus for use in a cooling system, and more particularly to a cooling apparatus having an evaporator with a conductive pipe which is wound spirally to have a cone-shape.

2. Prior Art

In general, a cooling system, like a refrigerator or an air conditioner, has a cooling apparatus for generating cool air. Such a conventional cooling system is shown in FIG. 1, which shows a refrigerator among the cooling systems. The refrigerator has a freezing compartment 1 and a fresh food compartment 2 which are separated from each other by a partitioning wall 3. An evaporator 4 is disposed in a cool air duct 7 which is in a back wall of the freezing compartment 1, and a compressor 6 is installed in the lower rear part of the refrigerator. A condenser (not shown) is disposed between the compressor 6 and the evaporator 4. The compressor 6 compresses refrigerant into gas having high pressure and high temperature, and the condenser condenses the gas into liquid by radiating heat from the gaseous state refrigerant. The liquid state refrigerant is supplied into the evaporator 4, and the evaporator 4 generates cool air by evaporating the refrigerant.

A blowing fan 5 is disposed on the upper side of the evaporator 4. The blowing fan 5 blows the cool air generated in the evaporator 4 into the freezing compartment 1. Accordingly, the foods in the freezing compartment 1 are frozen. Part of the cool air from the evaporator 4 is supplied into the fresh food compartment 2 through a refrigerating duct 8 disposed behind the cool air duct 7.

A defrosting heater 9 is disposed on the lower side of the evaporator 4. The defrosting heater 9 functions to defrost the evaporator 4 by providing heat thereto. When the amount of the frost generated on the evaporator 4 becomes larger than a predetermined amount as the cooling operation of the evaporator 4 continues, the compressor 6 stops operating and the defrosting heater 9 begins defrosting operation.

FIG. 2 is an enlarged view of the evaporator 4 in FIG. 1. The evaporator 4 has a conductive pipe 4*b* which is zigzag-shaped by being bent several times, and a plurality of heat exchange plates 4*a* which are disposed parallel with each other. The refrigerant supplied in the conductive pipe 4*b* evaporates in the conductive pipe 4*b* so as to absorb heat from the ambient air, and accordingly the cool air is generated around the evaporator 4. The plates 4*a* function to enhance the efficiency of heat exchange by enlarging the area which is in contact with the ambient air. The plates 4*a* are disposed parallel so that the longitudinal directions of the spaces formed thereby are in accordance with the circulating direction of the cool air formed by the blowing fan 5.

However, such a conventional cooling apparatus has the problem that the amount of heat exchange differs at each part of the evaporator 4. That is, the air which is forcedly circulated by the blowing fan 5 comes in contact with the lower part of the evaporator 4 first, and then the air cooled somewhat thereby comes in contact with the upper part of the evaporator 4 later, and accordingly the amount of heat exchange is smaller at the upper part of the evaporator 4 than that at the lower part of the evaporator 4. Also, since the frost is not generated uniformly at each part of the evaporator 4 but generated much more at the lower part of the evaporator 4 which has a larger amount of heat exchange, the period for defrosting operation is shortened and accordingly the cooling efficiency of the cooling apparatus becomes low.

SUMMARY OF THE INVENTION

The present invention has been proposed to overcome the above described problems in the prior art, and accordingly it is an object of the present invention to provide a cooling apparatus which performs heat exchange uniformly on the overall area of the evaporator and does not require defrosting operation frequently, and accordingly has high efficiency of cooling.

To achieve the above object, the present invention provides a cooling apparatus in a cooling system having a cool air duct disposed in a wall of a cooling compartment and being communicated with the cooling compartment, the cooling apparatus comprising: an evaporator having a conductive pipe being wound spirally along a longitudinal direction of the cool air duct for generating cool air in the cool air duct; and a means for blowing air toward the evaporator along an axial direction of the conductive pipe to provide the cool air compartment with the cool air, wherein a diameter of wound part of the conductive pipe increases gradually along a circulating direction of the cool air in the cool air duct.

It is preferable that the evaporator further comprises a plurality of fins for exchanging heat.

It is more preferable that the cooling apparatus further comprise a heater which is disposed coaxially with the conductive pipe in a cone-shaped space formed by the conductive pipe so as to defrost the evaporator efficiently.

Also, it is preferable that the conductive pipe has a plurality of bracket members for supporting the conductive pipe in order that the conductive pipe keeps a spiral shape.

Furthermore, by disposing the evaporator in an area adjacent to cool air discharging ports of the cool air duct, it is possible to achieve the effect that the cool air provided into the cooling compartment is dispersed uniformly therein.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
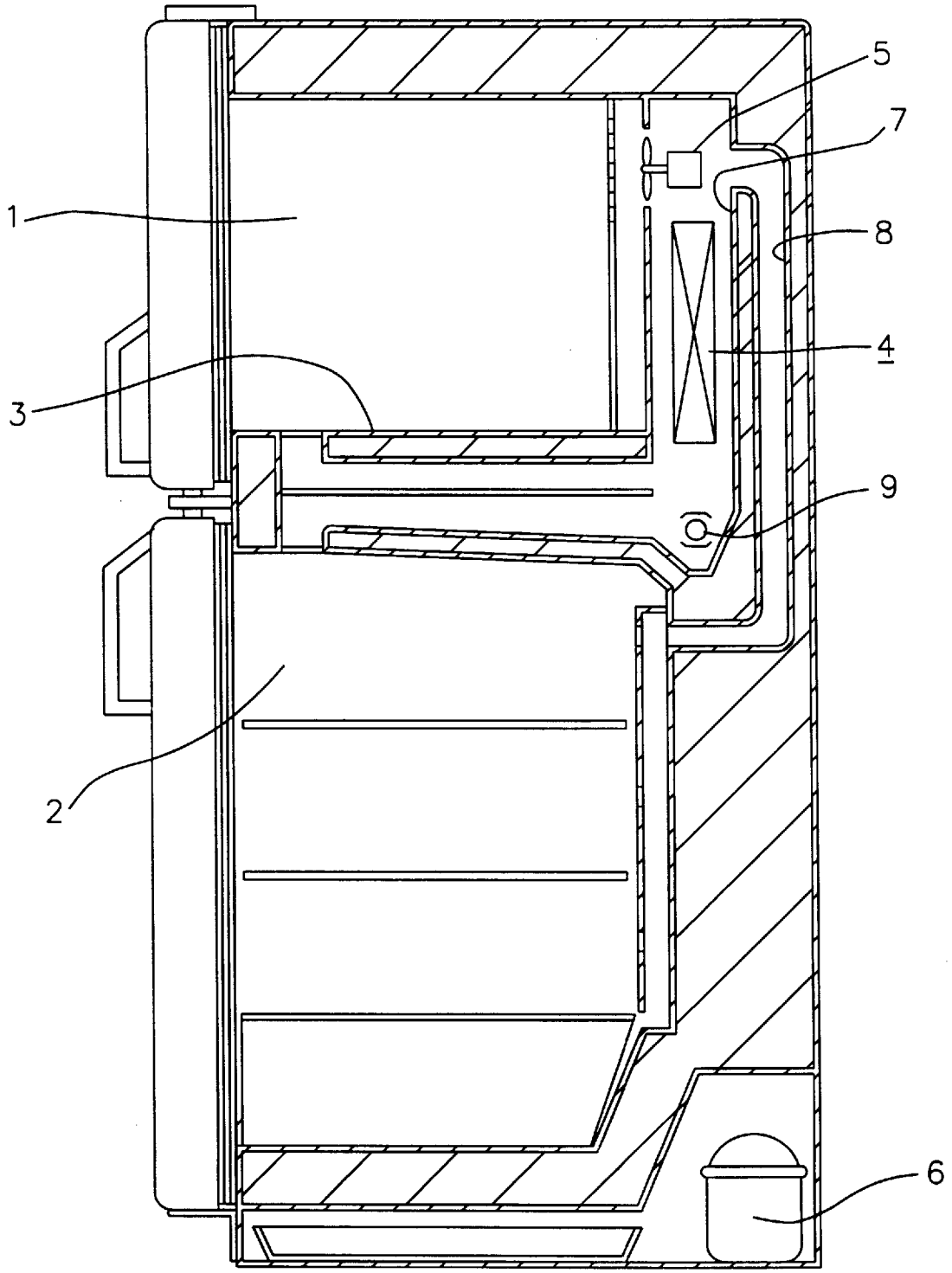
FIG. 1 PRIOR ART
FIG. 1 is a side sectional view of a refrigerator having a conventional cooling apparatus.
Figure 2:
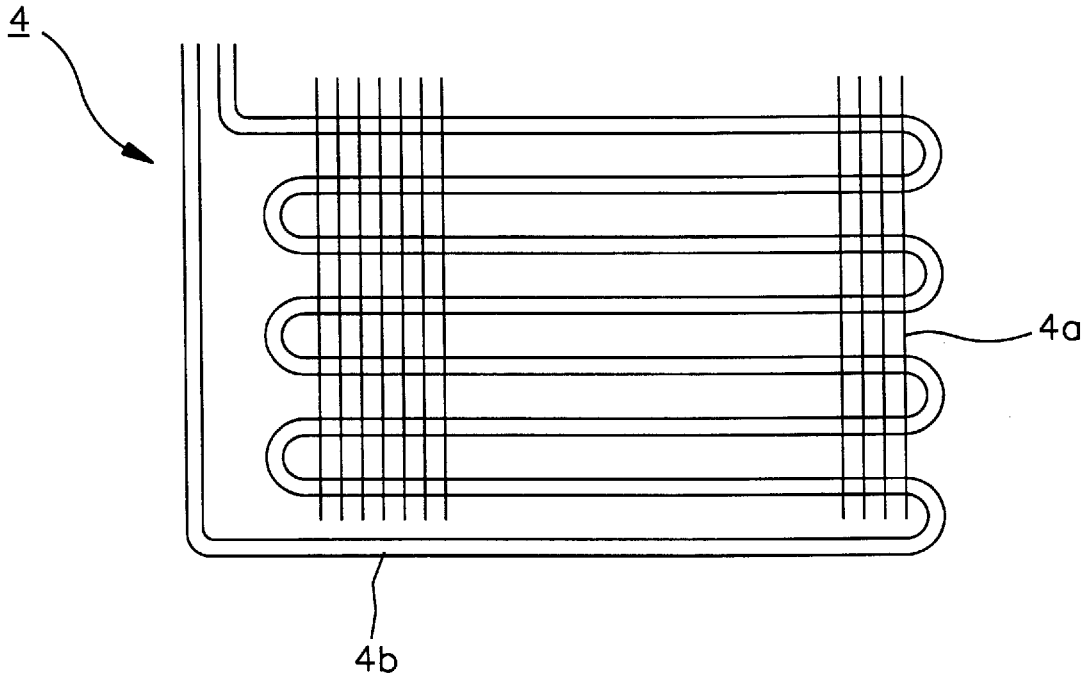
FIG. 2 is an enlarged view of the evaporator in the refrigerator as shown in FIG. 1.

Hereinafter, the present invention will be described in detail with reference to the drawings. In this embodiment, the case that the cooling apparatus according to the present invention is adopted to the refrigerator as shown in FIG. 1 is illustrated.

Figure 3:
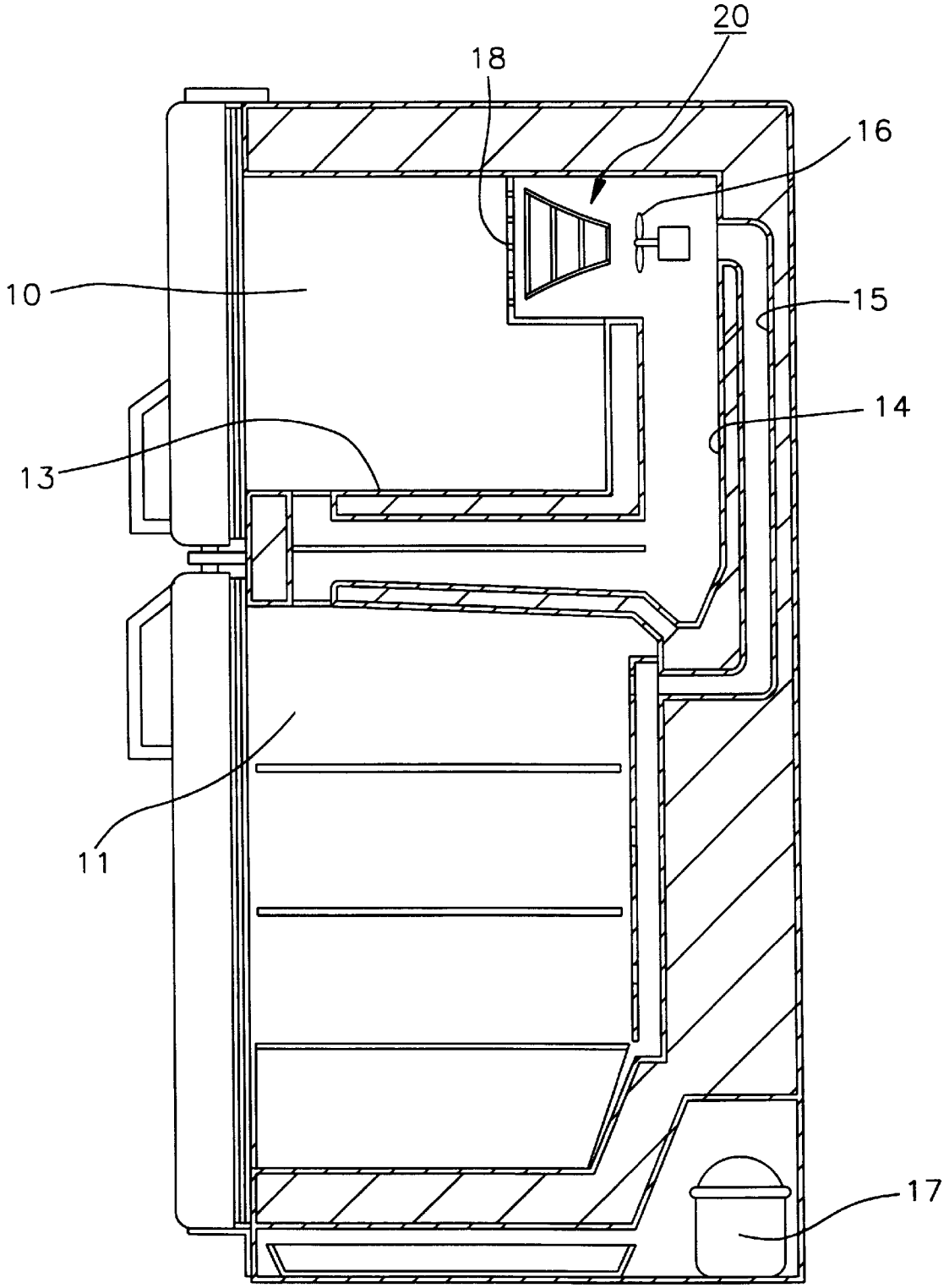
FIG. 3 is a side sectional view of a refrigerator having a cooling apparatus according to the present invention.

FIG. 3 is a side sectional view of a refrigerator having a cooling apparatus according to the present invention. The refrigerator having the cooling apparatus according to the present invention has, as the conventional refrigerator shown in FIG. 1, a freezing compartment 10 and a fresh food compartment 11 which are separated by a partitioning wall 13. In the back wall of the freezing compartment 10, a cool air duct 14 being communicated with the freezing compartment 10 is disposed in a vertical direction. An evaporator 20 is disposed in a cool air duct 14, and a compressor 17 is installed in the lower rear part of the refrigerator. The compressor 17 supplies the evaporator 20 with the compressed refrigerant thereby through a condenser (not shown) which condenses the compressed refrigerant. The evaporator 20 generates cool air by evaporating the refrigerant. Behind the evaporator 20, a blowing fan 16 for blowing toward the evaporator 20 is disposed. The cool air blown by the blowing fan 16 is provided into the freezing compartment 10 through a plurality of cool air discharging ports 18 formed at an end of the cool air duct 14. In the rear part of the cool air duct 14, a refrigerating duct 15 which is communicated with the fresh food compartment 11 is disposed. Part of the cool air from the evaporator 20 is provided into the fresh food compartment 11 through the refrigerating duct 15.

Figure 4:
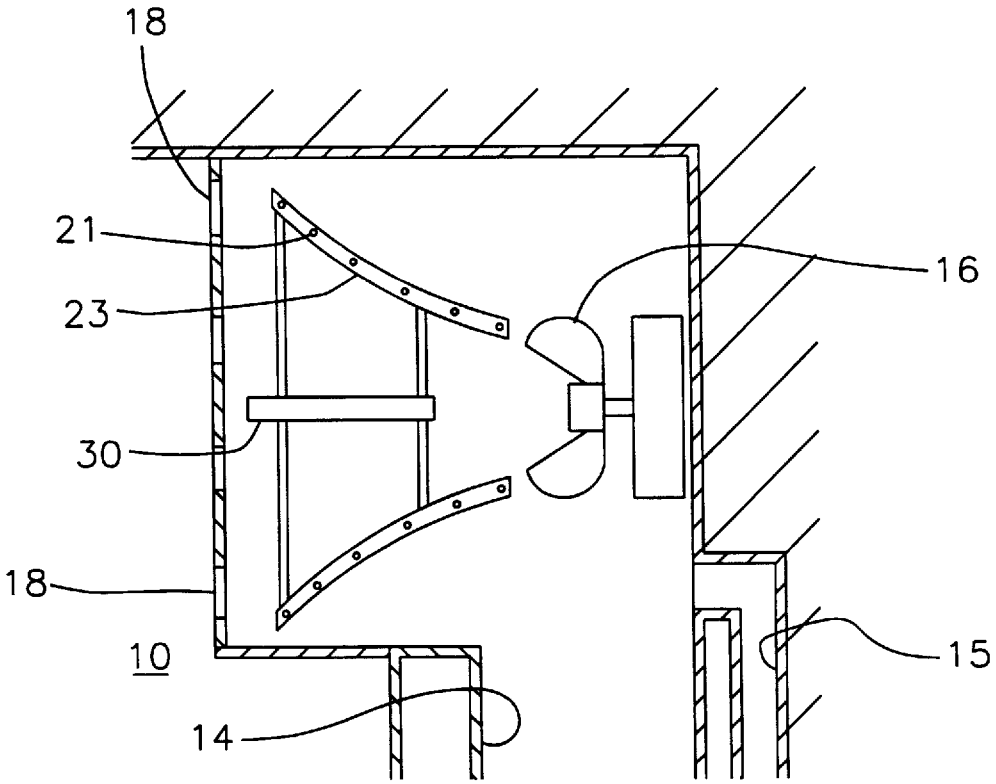
FIG. 4 is an enlarged partial sectional view of FIG. 3.
Figures 5, 5A:
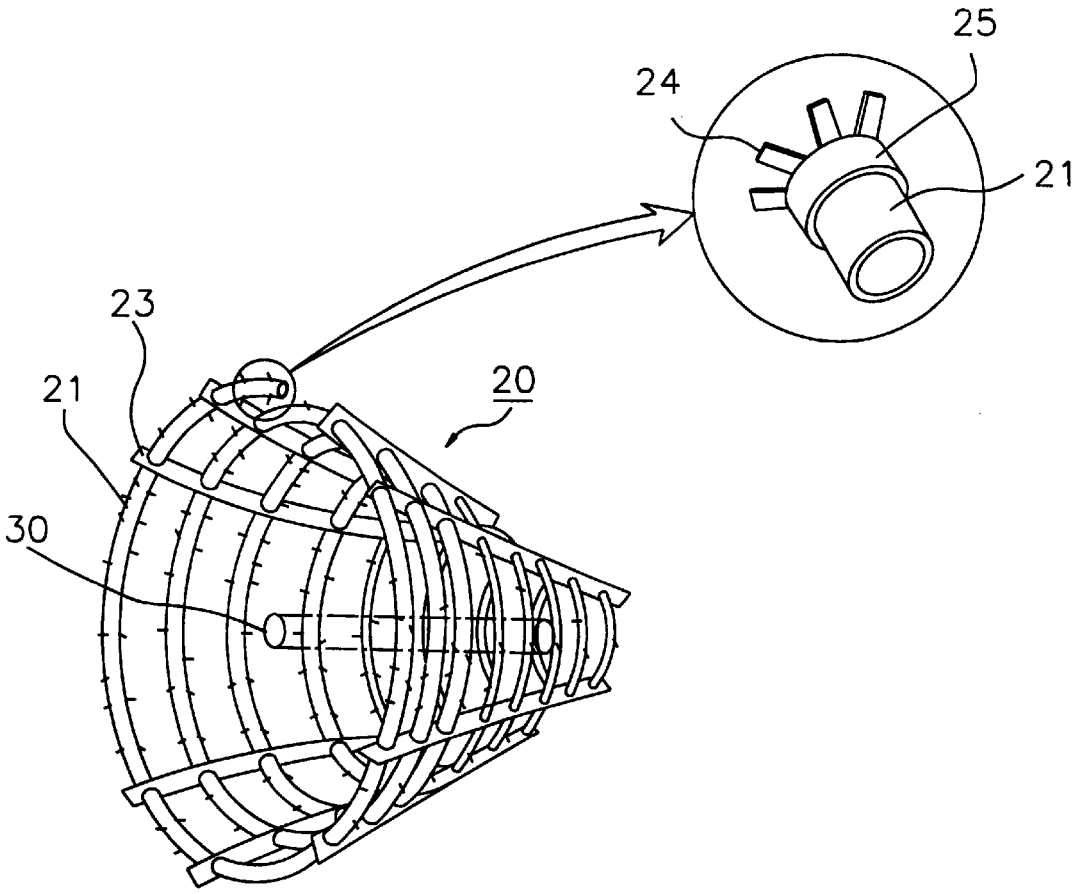
FIG. 5 is a perspective view of the evaporator as shown in FIG. 4.

FIG. 4 is an enlarged partial sectional view of FIG. 3, and FIG. 5 is a perspective view of the evaporator as shown in FIG. 4. The evaporator 20 is disposed at the upper end area of the cool air duct 14 therein to be adjacent to the cool air discharging ports 18 opened toward the freezing compartment 10. The evaporator 20 has a conductive pipe 21 which is wound spirally, a plurality of fin members 25 disposed on the outer surface of the conductive pipe 21, and bracket members 23 for supporting the spiral shape of the conductive pipe 21.

The conductive pipe 21 is formed so that the diameters of the wound part thereof may increase gradually along the circulating direction of the cool air in the cool air duct 14. That is, the conductive pipe 21 is wound to have a larger diameter at the front part which is adjacent to the cool air discharging ports 18 than the diameter at the rear part which is distant from the cool air discharging ports 18, and accordingly the conductive pipe 21 forms substantially cone-shaped space along a longitudinal axis of the conductive pipe 21 between the front and rear parts of the conductive pipe 21. The cone-shaped space defines a cool air guide duct for dispersely guiding the cool air blown by the blowing fan 16 to freezing compartment 10 through the cool air discharging ports 18. Also, the blowing fan 16 is adjacent to the rear part of the conductive pipe 21, and a diameter of the blowing fan 16 is equal to a diameter of the rear part of the conductive pipe 21 so that the conductive pipe 21 and the blowing fan 16 prevent the cool air from leaking out of the conductive pipe 21. One end of the conductive pipe 21 is connected to the condenser, and the other end thereof is connected to the compressor 17.

Fin members 25 are formed to be ring-shaped so as to surround the conductive pipe 21, and the fins 24 are disposed radially on the outer surface of the fin members 25. The fin members 25 are mounted almost on the entire area of the conductive pipe 21. The fin members 25 enlarge the area which is in contact with the ambient air in order to increase the amount of heat exchange therewith.

The bracket members 23 have a shape of a bar and are disposed nearly along the blowing direction by the blowing fan 16. The conductive pipe 21 is wound so that it may pass through the bracket members 23, and accordingly the conductive pipe 21 is kept in spiral cone-shape. In the cone-shaped cool air guide duct defined along a longitudinal axis of the conductive pipe 21 between the front and rear parts of the conductive pipe 21, a defrosting heater 30 for defrosting the evaporator 20 is disposed coaxially with the conductive pipe 21 and the blowing fan 16.

Hereinbelow, the function and effect of the refrigerator according to the present invention will be described.

When the refrigerator begins to operate, the compressor 17 begins to compress the refrigerant and the refrigerant is compressed into gas having high temperature and high pressure. The refrigerant radiates heat in the condenser to become a liquid state, and the liquid state refrigerant is supplied into the evaporator 20. The refrigerant evaporates in the conductive pipe 21 of the evaporator 20 so as to absorb heat from ambient air in the cool air duct 7, and accordingly the cool air is generated around the conductive pipe 21. The blowing fan 16 provides the cool air into the freezing compartment 10 by blowing toward the evaporator 20. At that time, part of the cool air is provided into the fresh food compartment 11 through the refrigerating duct 15.

The air blown by the blowing fan 16 is changed into the cool air by heat exchange with the evaporator 20. The blown air is contacted substantially with the entire area of the conductive pipe 21 all at once, and part of the blown air is rotated by the spiral shape of the conductive pipe 21 with being centered with the axis of the conductive pipe 21. Accordingly, the blown air forms a complex air flow, and the air passing through the evaporator 20 becomes in contact uniformly with the entire area of the evaporator 20 without uneven distribution of the contacted area, so the heat exchange efficiency is increased. Since the blowing fan 16 is adjacent to the rear part of the conductive pipe 21 and a diameter of the blowing fan 16 is equal to a diameter of the rear part of the conductive pipe 21, the conductive pipe 21 and the blowing fan 16 prevent the cool air from leaking out of the evaporator 20. Also, the fins 24 which are protruded radially on the substantially entire outer surface of the conductive pipe 21 not only function to enlarge the contacting area with ambient air but also function to generate more complex air flow, and therefore the heat exchange efficiency is increased more.

Also, since the blown air by the blowing fan 16 is in contact uniformly with almost the entire area of the evaporator 20, the frost is generated uniformly without maldistribution thereon, and the period for defrosting operation becomes longer. Accordingly, a lowering of efficiency for cooling operation which is due to frequent defrosting operation is prevented. Furthermore, since the defrosting heater 30 is disposed coaxially with the conductive pipe 21, the defrosting heater 30 serves to prevent the cool air passing over the evaporator 20 from being whirled therein, and the heat generated during the defrosting operation is transferred uniformly, so the efficiency in defrosting operation is increased.

Moreover, since the conductive pipe 21 substantially has a cone-shape, the blown air is dispersed as it passes therethrough. As the evaporator 20 is disposed near the cool air discharging ports 18, the cool air is dispersed the moment the cool air is discharged, so it is provided in almost overall area of the freezing compartment 10. Accordingly, the maldistribution in the degree of cooling of freezing compartment 10 does not occur and uniform cooling thereof is possible.

Although this embodiment illustrates the case that the spirally wound conductive pipe 21 is adopted to the evaporator 20, it is possible to adopt such a conductive pipe 21 to a general heat exchanging apparatus such as a condenser. Moreover, that can be adopted to general cooling systems, such as not only refrigerators but also air conditioners, and to other heat exchanging systems requiring heat exchange with ambient air.

As described above, according to the present invention the cooling apparatus having high efficiency of cooling is provided, and the uniform cooling of the freezing compartment becomes possible, since the heat exchange of the evaporator with ambient air is carried out efficiently by the conductive pipe which is spirally wound to have a cone-shape. Also, since the frost is generated uniformly on the entire area of the evaporator without maldistribution, the period for defrosting operation becomes longer so that the cooling efficiency is more improved, and specifically the efficiency for defrosting operation is improved by the defrosting heater which provides heat for defrosting evenly to the entire area of the conductive pipe.

Although the present invention has been described and illustrated in detail, it is clearly understood that the same is by way of illustration and example only and is not to be taken by way of limitation wherein the spirit and scope of the present invention is limited only by the terms of the appended claims.

What is claimed is:

1. A cooling apparatus in a cooling system having a cool air duct disposed in a wall of a freezing compartment and being communicated with said freezing compartment, said cooling apparatus comprising:

an evaporator disposed in an area adjacent to cool air discharging ports formed at an end portion of said cool air duct, said evaporator having a conductive pipe being wound spirally along a longitudinal direction of said cool air duct for generating cool air in said cool air duct, a plurality of fins each of the fins disposed radially on an outer surface of said conductive pipe for changing heat, wherein a diameter of wound part of the conductive pipe increases gradually along a circulating direction of the cool air in said cool air duct in such a manner that said conductive pipe is wound spirally to have a larger diameter than at a front part which is adjacent to the cool air discharging ports than a diameter at a rear part which is distant from the cool air discharging ports, and a cone-shaped cool air guide duct defined along a longitudinal axis of said conductive pipe between the front and rear parts of said conductive pipe for guiding the cool air to said freezing compartment through the cool air discharging ports;

a means disposed coaxially with said conductive pipe for blowing the cool air generated by said evaporator toward said freezing compartment along the longitudinal axis of said conductive pipe to provide said freezing compartment with the cool air, said blowing means being adjacent to the rear part of said conductive pipe and a diameter of said blowing means being equal to a diameter of the rear part of said conductive pipe; and a heater disposed coaxially with said conductive pipe and said blowing means in the cone-shaped cool air guide duct formed by said conductive pipe for defrosting said evaporator.

2. The cooling apparatus as claimed in claim 1, further comprising a plurality of bracket members for supporting said conductive pipe in order that said conductive pipe keeps a spiral shape, said bracket members having a shape of a bar through which said conductive pipe passes.

3. A cooling apparatus in a cooling system having a cool air duct disposed in a wall of a freezing compartment and being communicated with said freezing compartment, said cooling apparatus comprising:

an evaporator for generating cool air in said cool air duct, said evaporator being disposed in an area adjacent to cool air discharging ports formed at an end portion of said cool air duct which are open toward said freezing compartment, said evaporator having a conductive pipe being wound spirally along a longitudinal direction of said cool air duct, a plurality of fins each of the fins disposed radially on an outer surface of said conductive pipe for exchanging heat, wherein a diameter of wound part of the conductive pipe increases gradually along a circulating direction of the cool air in said cool air duct in such a manner that said conductive pipe is wound spirally to have a larger diameter than at a front part which is adjacent to the cool air discharging ports than a diameter at a rear part which is distant from the cool air discharging ports, and a cone-shaped cool air guide duct defined along a longitudinal axis of said conductive pipe between the front and rear parts of said conductive pipe by said conductive pipe for guiding the cool air to said freezing compartment through the cool air discharging ports;

a plurality of bracket members for supporting said conductive pipe in order that said conductive pipe keeps a spiral shape, said bracket members having a shape of a bar through which said conductive pipe passes;

a heater for defrosting said evaporator, said defrosting heater being disposed coaxially with said conductive pipe in the cone-shaped cool air guide duct formed by said conductive pipe; and a means disposed coaxially with said conductive pipe and said heater for blowing the cool air generated by said evaporator toward said freezing compartment along the longitudinal axis of said conductive pipe to provide said freezing compartment with the cool air, said blowing means being adjacent to the rear part of said conductive pipe and a diameter of said blowing means being equal to a diameter of the rear part of said conductive pipe.

* * * * *